US008607708B1

(12) United States Patent
McClenahan et al.

(10) Patent No.: US 8,607,708 B1
(45) Date of Patent: Dec. 17, 2013

(54) IMPACT IGNITING INCENDIARY DEVICE FOR PROJECTILES

(75) Inventors: Charles H. McClenahan, Fort Walton Beach, FL (US); William B. Walter, Fort Walton Beach, FL (US); Chad G. Rumchick, Crestview, FL (US); Mitcheal A. Cooksey, Jr., Logan, UT (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 13/118,839

(22) Filed: May 31, 2011

(51) Int. Cl.
*F42B 12/40* (2006.01)

(52) U.S. Cl.
USPC ..... 102/513; 102/491; 102/500

(58) Field of Classification Search
USPC ..... 102/399, 477, 491, 494, 497, 513, 364, 102/510
See application file for complete search history.

(56) References Cited

U.S. PATENT DOCUMENTS

| | | | | | |
|---|---|---|---|---|---|
| 3,238,877 | A | | 3/1966 | Simmons | |
| 3,291,048 | A | | 12/1966 | Lubbers | |
| 3,374,741 | A | | 3/1968 | Bass | |
| 3,407,734 | A | * | 10/1968 | MacDonald | 102/500 |
| 3,440,963 | A | | 4/1969 | De Luca | |
| 3,467,012 | A | * | 9/1969 | Lapof | 102/364 |
| 3,576,165 | A | | 4/1971 | Gawlick et al. | |
| 3,623,432 | A | | 11/1971 | Schminke | |
| 3,861,311 | A | | 1/1975 | Bilsbury | |
| 4,112,843 | A | | 9/1978 | Laviolette | |
| 4,216,722 | A | * | 8/1980 | Angell | 102/491 |
| 4,436,035 | A | * | 3/1984 | Strandli | 102/364 |
| 4,488,490 | A | * | 12/1984 | Betts | 102/513 |
| 4,672,897 | A | | 6/1987 | Betts | |
| 4,827,846 | A | | 5/1989 | Smolnik | |
| 4,911,080 | A | | 3/1990 | Leeker et al. | |
| 5,763,819 | A | * | 6/1998 | Huffman | 102/510 |
| 2010/0282117 | A1 | * | 11/2010 | Cranor et al. | 102/513 |

* cited by examiner

*Primary Examiner* — Michelle Clement
*Assistant Examiner* — John D Cooper
(74) *Attorney, Agent, or Firm* — AFMCLO/JAZ; Fredric Sinder

(57) ABSTRACT

An improved apparatus and method for fitting a normally non-explosive containing projectile with a spotting charge. A spotting charge capsule is inserted into an opening in the front of a projectile. The opening may be made by removing part of the nose of the projectile and making a shaped opening for inserting the spotting charge capsule. The spotting charge capsule includes an opening at its front and a bore behind the opening leading to a cavity for holding an explosive mixture, usually one or more pressed incendiary pellets. The opening and bore together form a venturi, or venturi-like, tube. The tube ends short of the cavity leaving only a thin wall between the bore and the explosive. On impact on soft media, such as dirt, sand or mud, the soft media will enter the tube and shear the thin wall, creating a high speed flier plate that ignites the explosive mixture.

4 Claims, 3 Drawing Sheets

IMPACT IGNITING INCENDIARY DEVICE FOR PROJECTILES

RIGHTS OF THE GOVERNMENT

The invention described herein may be manufactured and used by or for the Government of the United States for all governmental purposes without the payment of any royalty.

BACKGROUND OF THE INVENTION

The present invention relates generally to cannon ammunition and other projectiles, and more specifically to an insert assembly that adds a spotting charge to normally non-explosive shells.

Air Force AC-130 gunship weapons include a 40 mm Bofors cannon. For most military operations, the cannon fires a high explosive incendiary shell.

Such high-explosive incendiary shells are in both short supply and expensive, severely limiting their use for training.

There is a large supply of surplus World War II 40 mm armor-piercing rounds that are used for training, but because they don't contain any explosive, it is difficult to visually determine ground strikes. Without an impact signature, aircrews and ground crews cannot assess shot placement and correct the fire control system for errors.

There is a large prior art of so-called spotting charges for use in training and practice projectiles, both projectiles designed and built specifically for those purposes and for retrofit units used to convert normally non-explosive shells, such as so-called dummy warheads, to spotting charge projectiles.

A careful search of the prior art reveals that all these prior art spotting charges use complex mechanisms to trigger or ignite the spotting charge or other explosive or incendiary material used for creating a visual or audible, or both, effect. The prior art need for such complex mechanisms is because typical incendiary materials and mixtures will normally only initiate or ignite on hard impact or under a heavy shear.

Those mechanisms typically include a penetrator or similar component that, when the projectile strikes a surface, shoots forward to ignite a primer charge to then ignite the spotting charge. These mechanisms are usually very similar to those used to ignite both primer (or percussion) and main charges in regular explosive shells.

The simplest mechanism found in the prior art is that described in U.S. Pat. No. 4,488,490 to Betts. The Betts spotting charge is designed for use with a solid propellant rocket. A percussion primer material fills a cavity in the front of the rocket and ignites from the impact of the rocket striking a hard target. The pressurized hot gases from the percussion primer are communicated through a bore behind the cavity to the pyrotechnic spotting charge.

While the Betts spotting charge is a clear improvement in simplicity over the other prior art, it is limited to use with hard targets.

Typical gunship targets, in addition to hard surface targets, include soft surfaces such as vegetation and ground.

It is seen, therefore, that there is a need for new and simpler solutions, and thus less expensive, for the prior art problem of adding a visual and audible impact signature for non-explosive containing ammunition and other projectiles.

There is a particular need for new and simpler solutions that will work for impacts on soft, as well as hard, surfaces.

SUMMARY OF THE INVENTION

The present invention provides a new spotting charge capsule assembly for non-explosive containing projectiles, such as armor-piercing rounds or practice rounds, that converts them into spotting shells. The new capsule is inserted into the front of a projectile and provides both visual and audible signatures on impact with both soft and hard surfaces, providing a shooter an absolute reference point of impact.

What's new in the present invention's solution to the problems of the prior art includes an opening and bore at the front of the capsule insert that forms a venturi, or venturi-like, tube for focusing a jet of soft surface material, such as dirt, sand or mud, through the tube to strike and break a thin wall section at the inside end of the tube. The broken section acts as a high speed flier plate which then strikes and ignites an incendiary material in a cavity behind the tube.

The new spotting charge capsule provides both visual and audible impact signatures upon impact with a target or other surface, giving a shooter an absolute reference point of impact. The capsule can be manufactured independently from the ammunition, enabling conversion of existing stockpiles of conventional training ammunition, as well as for newly manufactured ammunition.

Also new in the present invention's solution is that a hard target impact, such as against concrete or a vehicle, will crush the nose of the projectile, including the capsule insert, and the resulting collapse into the incendiary mixture will similarly ignite the mixture, without requiring a separate percussion primer, and thereby also provide an audible and visible signature.

Accordingly, the invention is directed to a spotting charge capsule having a front and a length, comprising an opening into the front of the capsule, a bore extending from the opening along the length of the capsule to a bore end, a cavity inside the capsule extending from near the bore end to further inside the capsule, and, an incendiary mixture inside the cavity. The spotting charge capsule may include a void in the incendiary mixture near the bore end. The spotting charge capsule opening may also be wider than the bore. The portion of the capsule between the bore end and the cavity may be a thin wall. The portion of the capsule between the bore end and the cavity may also be easily breakable.

The invention is also directed to a method for igniting an explosive charge on impact onto a soft surface, comprising the steps of providing a bore in front of the explosive charge, the bore open at an end furthest from the explosive charge and closed at an end closest to the explosive charge, forming an easily breakable section between the bore and the explosive charge, and firing the projectile at a soft surface.

DETAILED DESCRIPTION

Figure 1:
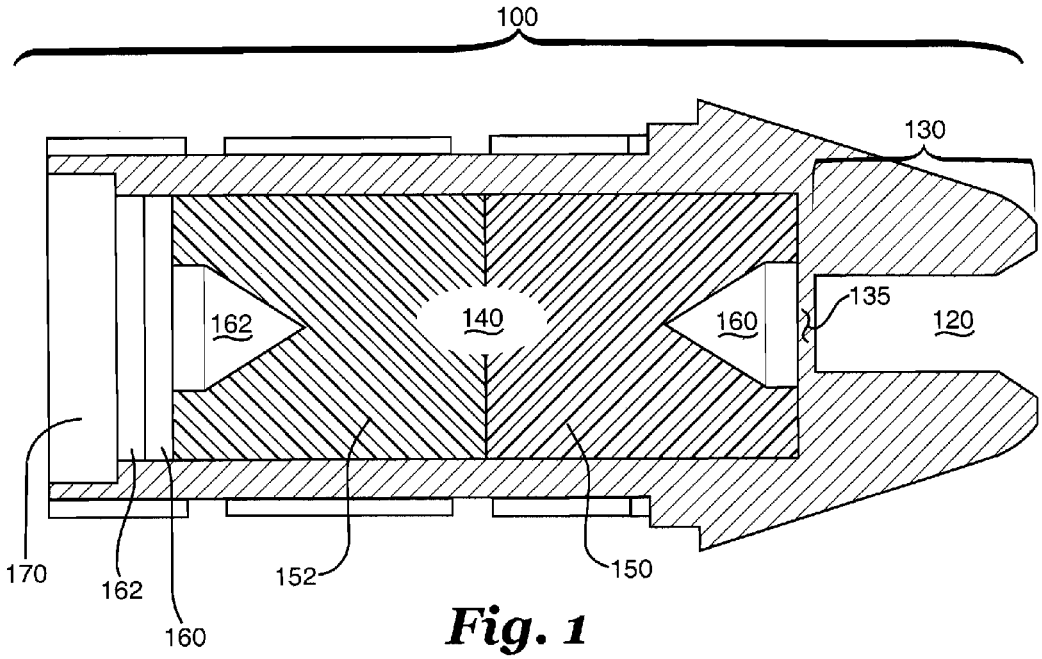
FIG. 1 is a cross-sectional view of an example embodiment of a spotting charge capsule according to the teachings of the present invention.

FIG. 1 is a cross-sectional view of an example embodiment of a spotting charge capsule 100 according to the teachings of the present invention. An opening 110 connects to a narrower bore 120 to create a venturi, or venturi-like, tube 130. Tube 130 is referred to here as a venturi tube because, as will be shown, creating a venturi effect, that is, causing whatever flows through the tube to increase its velocity, is desirable, and is most descriptive of the operation of the invention, but is not absolutely critical to its successful operation.

Venturi tube 130 extends to near a cavity 140 formed inside capsule 100, leaving a thin wall section 135 separating venturi tube 130 from cavity 140. An incendiary mixture, in this example embodiment comprising a pair of pressed incendiary pellets 150 and 152, mostly fills cavity 140 and includes a pair of conical voids 160 and 162.

The back of cavity 140 is sealed, as shown here, with a pair of felt disks 160 and 162 and an aluminum disk 170, held in place by industrial adhesive, but in practice epoxy adhesive alone works as well.

Figure 2:
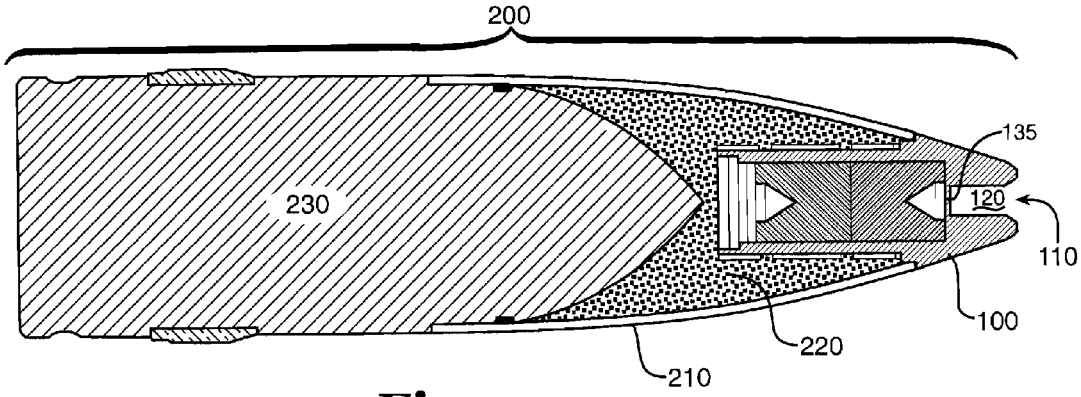
FIG. 2 is a cross-sectional view of the FIG. 1 spotting charge capsule inserted into the front of a conventional armor-piercing round.

FIG. 2 is a cross-sectional view of spotting charge capsule 100 inserted into the front of a conventional armor-piercing round or projectile 200. In this example embodiment, projectile 200 includes an armor piercing section 230 and an aerodynamic nose cone 210. Armor piercing section 230 typically will be made of materials too hard for drilling, so that the presence of nose cone 210 facilitates incorporating capsule 100 into projectile 200. A portion of the original ogive/meplat outline of nose cone 210 is cut away and capsule 100 inserted. Capsule 100 can be held in place by standard industrial adhesives, such as STYCAST, a commonly used epoxy-based two-part encapsulant.

Figure 3:
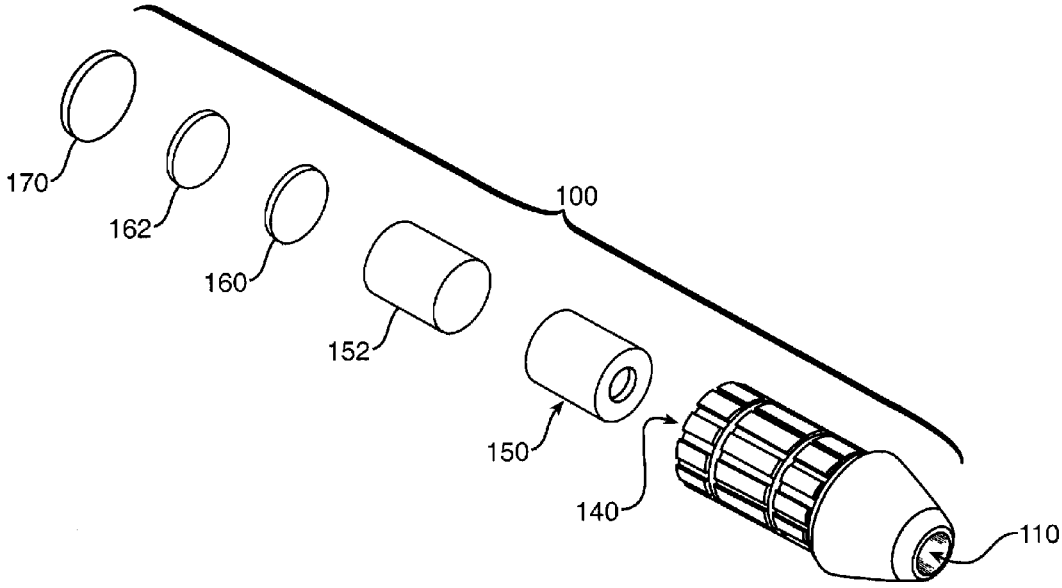
FIG. 3 is an exploded view of the primary components of the FIG. 1 spotting charge capsule.

FIG. 3 is an exploded view of the primary components of spotting charge capsule 100. Capsule 100 can be made from any of a variety of material, such as 7075 aluminum alloys. While 7075 aluminum works well, in part because it becomes brittle on impact, making it easier for thin wall section 135 to shear and form a high speed flier plate, some newer plastics may work as well.

A capsule built according to the teachings of the present invention will typically function in either of two modes. As incendiary mixtures typically will only initiate or ignite on hard impact or under a heavy shear, the problem is igniting the mixture on impact onto a soft surface such as vegetation or bare ground.

The primary initiation mode is by impact on such soft surface media as dirt, sand and mud. The impact forces the surface media into venturi tube 130. As a jet of surface media transits through venturi tube 130, it impacts and shears thin wall section 135 to create a high speed flier plate. The flier plate will then enter conical void 160 and the resulting high shear force and pressure will ignite incendiary pellets 150 and 152.

Thin wall section 135 may be formed by any of many manufacturing methods as those with skill in those arts will readily see. While thin wall section 135 is described a thin wall, it may be any of a variety of other forms in keeping with the teachings of the present invention. The only requirement is that it be easily breakable, or easily sheared, when struck with soft surface media. Similarly, it is not necessary that it break off to form a high speed flier plate, but only that any broken or sheared pieces be able to ignite an incendiary mixture.

The secondary initiation mode is hard target impact, such as on concrete or a vehicle. The front of the capsule, and the remaining nose material of projectile 200, will collapse on impact, crushing incendiary capsule 100, creating both friction and pressure which will in turn ignite incendiary pellets 150 and 152.

Both initiation modes result in a bright flash and loud audible signature.

New uses for projectiles are made possible by the teachings of the present invention. For example, projectiles made or modified according to the teachings of the present invention can be used as low collateral damage shells in combat.

The disclosed new apparatus and method for igniting an explosive mixture successfully demonstrates the use of physical effects, such as the venturi effect, to achieve results usually requiring complex mechanisms. Although the disclosed example embodiments are specialized, their teachings will find application in related areas where physical effects can be use to replace complex mechanic apparatus.

The use of the term "bore," similar to the use of the term "venturi," is used to aid understandability. Those with skill in the art will readily understand that the term "bore," which implies a straight passage having straight sides, for purpose of claim construction, may include a passage of any shape, as long as it fulfills the teachings of the invention to funnel, in effect, soft surface media to shear a thin section to create a flier plate. Claiming a "passage," while more clearly conveying a broad meaning, less well teaches how to best make and use the invention.

Various other modifications to the invention as described may be made, as might occur to one with skill in the art of the invention, within the scope of the claims. Therefore, all contemplated embodiments have not been shown in complete detail. Other embodiments may be developed without departing from the spirit of the invention or from the scope of the claims.

We claim:

1. A spotting charge capsule having a front tip and a length, comprising:

(a) an opening into the front tip of the capsule;

(b) a bore extending from the opening along the length of the capsule to a bore end, wherein the cross-sectional area of the bore at the opening is greater than at the bore end;

(c) a cavity inside the capsule extending from near the bore end to further inside the capsule; and, (d) an incendiary mixture inside the cavity.

2. The spotting charge capsule according to claim 1, further comprising a void in the incendiary mixture near the bore end.

3. The spotting charge capsule according to claim 1, wherein the portion of the capsule between the bore end and the cavity is easily breakable.

4. A method for igniting an explosive charge on impact onto a soft surface, comprising the steps of firing the explosive charge at the soft surface:

(a) wherein the explosive charge is inside a cavity inside a capsule, the capsule having a front tip, a length and including;

(i) an opening into the front tip; and, (ii) a bore extending from the opening along the length of the capsule to a bore end, wherein the cross-sectional area of the bore at the opening is greater than at the bore end;

(b) wherein the cavity extends from near the bore end to further inside the capsule; and, (c) wherein the portion of the capsule between the bore end and the cavity is easily breakable.

* * * * *